US006899643B2

(12) United States Patent
Sajima et al.

(10) Patent No.: US 6,899,643 B2
(45) **Date of Patent: *May 31, 2005**

(54) GOLF BALL

(75) Inventors: Takahiro Sajima, Kobe (JP); Seiichiro Endo, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/694,886

(22) Filed: Oct. 29, 2003

(65) Prior Publication Data

US 2004/0142771 A1 Jul. 22, 2004

(30) Foreign Application Priority Data

Nov. 15, 2002 (JP) ..... 2002-332589

(51) Int. Cl.[7] ..... A63B 37/14
(52) U.S. Cl. ..... 473/383
(58) Field of Search ..... 473/378–385

(56) References Cited

U.S. PATENT DOCUMENTS 5,735,757 A 4/1998 Moriyama
6,368,238 B1 4/2002 Kasashima et al.
2004/0102259 A1 * 5/2004 Ohama et al. ..... 473/378

* cited by examiner

*Primary Examiner*—Raeann Gorden
(74) *Attorney, Agent, or Firm*—Birch, Stewart, Kolasch & Birch, LLP

(57) ABSTRACT

A golf ball comprises a large number of dimples (4) on a surface thereof. The dimple (4) includes a first curved surface (7) provided from a position (P2) placed downward by 85% of a depth to a position (P1) placed downward by 100% of the depth in a direction of the depth from an edge (E) and a second curved surface (8) provided from a position (P5) placed downward by 20% of the depth to a position (P3) placed downward by 50% of the depth in the direction of the depth from the edge (E). A percentage, to a total number of the dimples, of a number of the dimples in which a ratio (R1/R2) of a radius of curvature (R1) of the first curved surface (7) to a radius of curvature (R2) of the second curved surface (8) is 5 to 55 is 20% or more. A third curved surface (9) is present between the first curved surface (7) and the second curved surface (8). A fourth curved surface (10) is present between the second curved surface (8) and the edge (E). A distance (F) between the deepest portion (P2) of the dimple (4) and a phantom sphere (6) is 0.10 mm to 0.60 mm.

2 Claims, 4 Drawing Sheets

GOLF BALL

This nonprovisional application claims priority under 35 U.S.C. §119(a) on Patent Application No. 2002-332589 filed in JAPAN on Nov. 15, 2002, the entire contents of which are hereby incorporated by reference.

BACKGROUND OF THE INVENTION

1. Field of the Invention

The present invention relates to a golf ball. More particularly, the present invention relates to an improvement in the sectional shape of a dimple.

2. Description of the Related Art

A golf ball has a large number of dimples on a surface thereof. The role of the dimples resides in one aspect that such dimples disturb an air stream around the golf ball during the flight, thereby causing a turbulent flow separation (which will be hereinafter referred to as a "dimple effect"). A separating point of air from the golf ball is shifted backward by the turbulent flow separation so that a drag coefficient (Cd) is reduced. By the reduction in the drag coefficient, the flight performance of the golf ball can be enhanced.

An improvement in the sectional shape of the dimple intended for an enhancement in the flight performance has variously been proposed Japanese Laid-Open Patent Publication No. Hei 9-70449 has disclosed a golf ball comprising a double radius dimple having a predetermined shape. Japanese Laid-Open Patent Publication No. 2000-279553 has disclosed a golf ball comprising a dimple in which a peripheral edge portion is a rounded and curved surface.

A golf player is most concerned about the flight distance of a golf ball. In respect of an enhancement in the flight distance, the sectional shape of a dimple has room for an improvement.

SUMMARY OF THE INVENTION

A golf ball according to the present invention comprises a large number of dimples on a surface thereof. In the golf ball, a percentage of a number of the dimples to satisfy the following (1) and (2) to a total number of the dimples is 20% or more.

(1) The dimple include's a first curved surface provided from a position placed downward by 85% of a depth to a position placed downward by 100% of the depth in a direction of the depth from a dimple edge and a second curved surface provided from a position placed downward by 20% of the depth to a position placed downward by 50% of the depth in the direction of the depth from the dimple edge.

(2) A ratio (R1/R2) of a radius of curvature R1 of the first curved surface to a radius of curvature R2 of the second curved surface is 5 to 55.

It is preferable that a distance F between the deepest portion of the dimple and a phantom sphere should be 0.10 mm to 0.60 mm.

DESCRIPTION OF THE PREFERRED EMBODIMENTS

A preferred embodiment of the present invention will be described below in detail with reference to the drawings.

Figure 1:
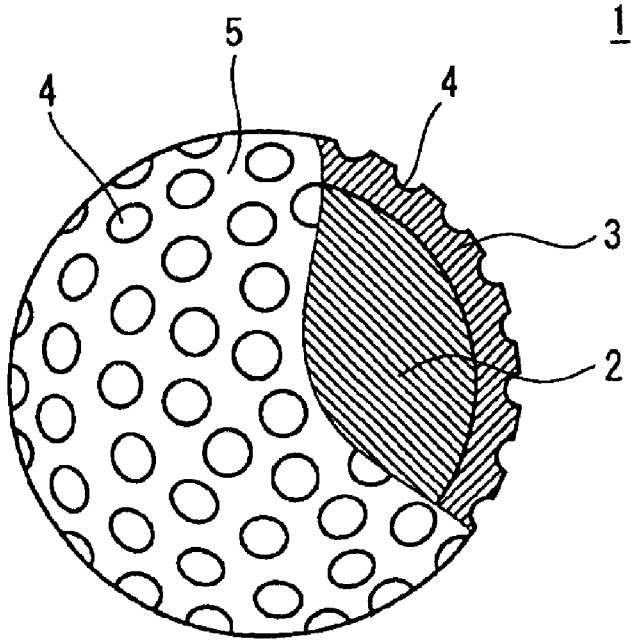
FIG. 1 is a sectional view showing a golf ball according to an embodiment of the present invention, a part of which is taken away.

A golf ball 1 shown in FIG. 1 comprises a spherical core 2 and a cover 3. A large number of dimples 4 are formed on the surface of the cover 3. A portion of the surface of the golf ball 1 other than the dimple 4 is a 1 and 5. The golf ball 1 has a paint layer and a mark layer on the outside of the cover 3, which are not shown.

The golf ball 1 usually has a diameter of 40 mm to 45 mm, and furthermore, 42 mm to 44 mm. In consideration of a reduction in an air resistance within such a range that the standards of the United States Golf Association (USGA) are satisfied, it is particularly preferable that the diameter should be 42.67 mm to 42.80 mm. The golf ball 1 usually has a weight of 40 g to 50 g, and furthermore, 44 g to 47 g. In consideration of an enhancement in an inertia within such a range that the standards of the USGA are satisfied, it is particularly preferable that the weight should be 45.00 g to 45.93 g.

The core 2 is formed by crosslinking a rubber composition. Examples of the base rubber of the rubber composition include polybutadiene, polyisoprene, a styrene-butadiene copolymer, an ethylene-propylene-diene copolymer and a natural rubber. Two or more kinds of rubbers may be used together. In respect of a resilience performance, the polybutadiene is preferable and high cis-polybutadiene, is particularly preferable.

A co-crosslinking agent is usually used for crosslinking the core 2. In respect of the resilience performance, examples of a preferable co-crosslinking agent include zinc acrylate, magnesium acrylate, zinc methacrylate and magnesium methacrylate. It is preferable that an organic peroxide, together with the co-crosslinking agent, should be blended with the rubber composition. Examples of a suitable organic peroxide include dicumyl peroxide, 1,1-bis(t-butyl peroxy)-3,3,5-trimethyl cyclohexane, 2,5-dimethyl-2,5-di(t-butyl peroxy) hexane and di-t-butyl peroxide.

Various additives such as a tiller, sulfur, an antioxidant, a coloring agent, a plasticizer and a dispersing agent are blended in a proper amount with the rubber composition if necessary. Crosslinked rubber powder or synthetic resin powder may be blended with the rubber composition of the core 2.

The core 2 usually has a diameter of 30.0 mm to 42.0 mm, and particularly 38.0 mm to 41.5 mm. The core 2 may be constituted by two layers or more.

The cover 3 is formed by a synthetic resin composition. Examples of the base resin of the cover 3 include an ionomer resin, a thermoplastic polyurethane elastomer, a thermoplastic polyamide elastomer, a thermoplastic polyester elastomer, and a thermoplastic polyolefin elastomer.

A coloring agent, a filler, a dispersing agent, an antioxidant, an ultraviolet absorbent, a light stabilizer, a fluorescent agent, a fluorescent brightening agent or the like is blended in a proper amount with the cover 3 if necessary. In order to regulate a specific gravity, powder of a metal having a high specific gravity such as tungsten or molybdenum may be blended with the cover 3.

The cover 3 usually has a thickness of 0.3 mm to 6.0 mm, and particularly 0.6 mm to 2.4 mm. The cover 3 may be constituted by two layers or more.

Figure 2:
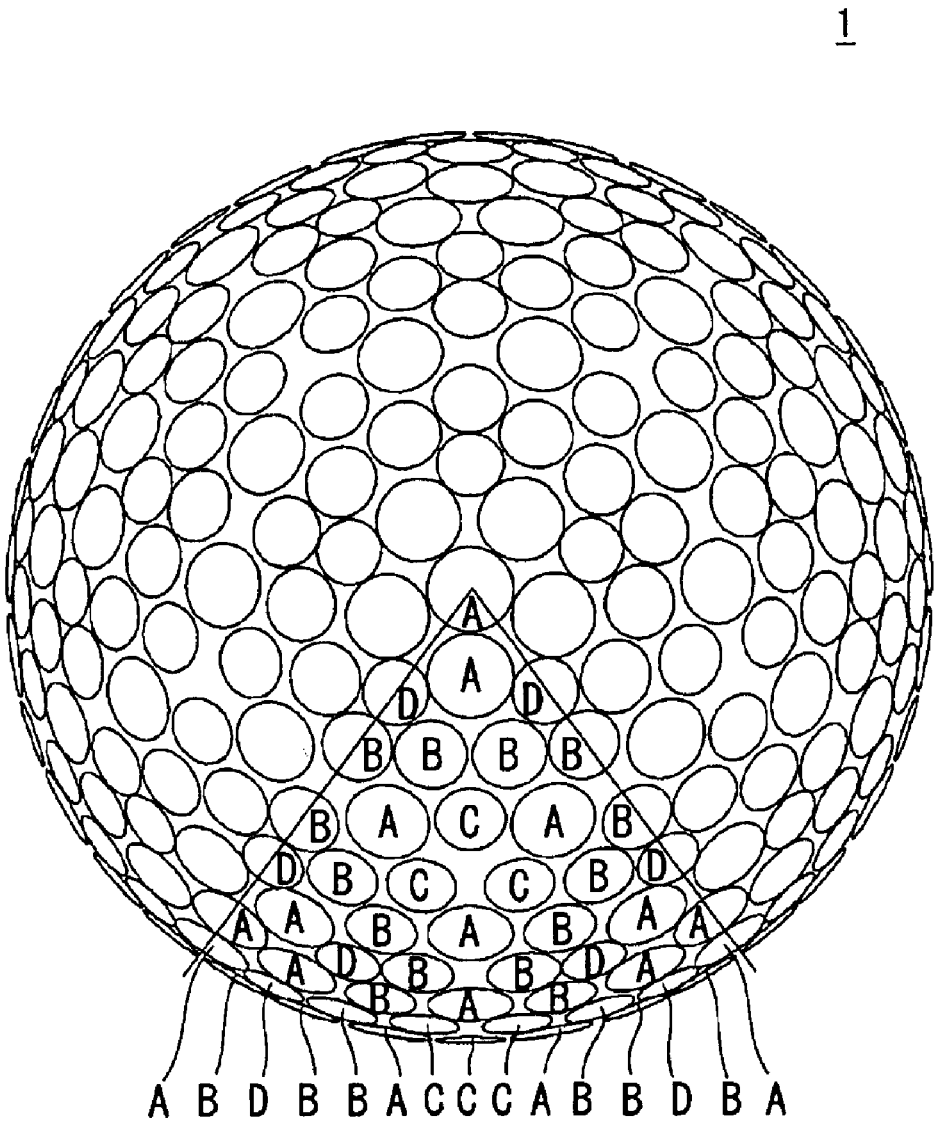
FIG. 2 is an enlarged plan view showing the golf ball of FIG. 1.
Figure 3:
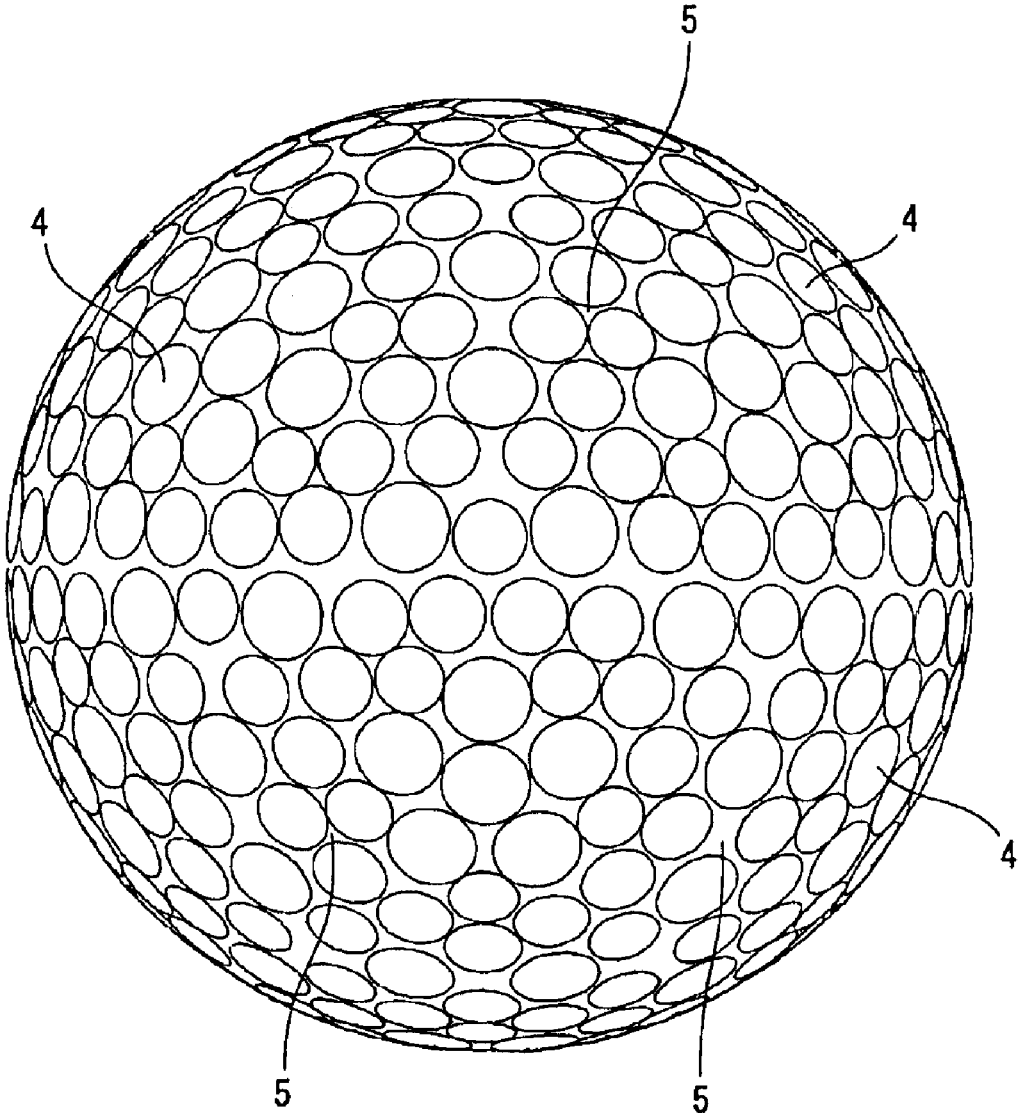
FIG. 3 is an enlarged front view showing the golf ball of FIG. 1.

FIG. 2 is an enlarged plan view showing the golf ball 1 in FIG. 1 and FIG. 3 is a front view showing the golf ball 1. As is apparent from FIGS. 2 and 3, all the dimples 4 have circular plane shapes. In FIG. 2, the types of the dimple 4 are indicated as A to D in one of ten equivalent units obtained by comparting the surface of the golf ball 1. The golf ball 1 includes an A dimple having a diameter of 4.1 mm, a B dimple having a diameter of 3.6 mm, a C dimple having a diameter of 3.4 mm and a D dimple having a diameter of 3.2 mm. The number of the A dimples is 132, that of the B dimples is 180, that of the C dimples is 60 and that of the D dimples is 60. The total number of the dimples 4 of the golf ball 1 is 432.

Figure 4:
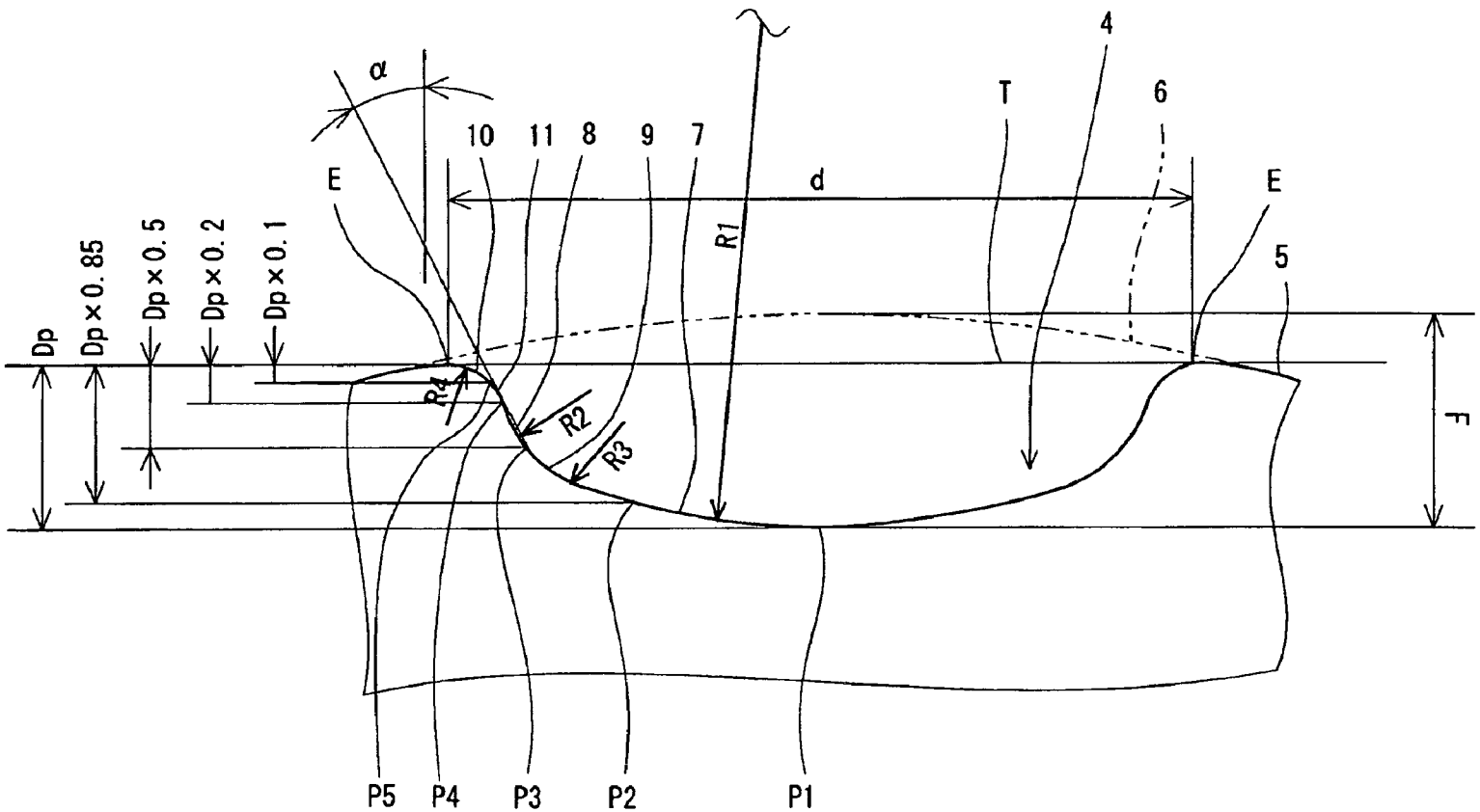
FIG. 4 is a typical enlarged sectional view showing a part of the golf ball in FIG. 1.

FIG. 4 is a longitudinally enlarged sectional view showing a part of the golf ball 1 in FIG. 1. FIG. 4 illustrates a section passing through the deepest portion of the dimple 4 and the center of the golf ball 1. A vertical direction in FIG. 4 indicates a direction of the depth of the dimple 4. The direction of the depth is a direction from the center of gravity of the area of the dimple 4 toward the center of the golf ball 1. In FIG. 4, a phantom sphere 6 is shown in a two-dotted chain line. The surface of the phantom sphere 6 is the surface of the golf ball 1 on the assumption that the dimple 4 is not present. The dimple 4 is concaved from the phantom sphere 6. The 1 and 5 is coincident with the phantom sphere 6.

In FIG. 4, the diameter of the dimple 4 is shown in an arrow d. The diameter, d is equal to a distance between one of contacts E and the other contact E in the case in which a common tangential line T is drawn on both sides of the dimple 4. The contact E is also the edge of the dimple 4. The edge E defines the plane shape of the dimple 4. In FIG. 4, the reference numeral P1 denotes the deepest portion of the dimple 4. A distance between the tangential line T and the deepest portion P1 indicates a depth Dp of the dimple 4.

In FIG. 4, the reference numeral P2 denotes a lower point from the edge E by a distance of (Dp·0.85). The reference numeral P3 denotes a lower point from the edge E by a distance of (Dp·0.5). The reference numeral P4 denotes a lower point from the edge E by a distance of (Dp·0.2). The reference numeral P5 denotes a lower point from the edge E by a distance of (Dp·0.1).

The dimple 4 includes a first curved surface 7, a second curved surface 8, a third curved surface 9, a fourth curved surface 10 and a fifth curved surface 11. The first curved surface 7 is bowl-shaped, and the second curved surface 8, the third curved surface 9, the fourth curved surface 10 and the fifth curved surface 11 are ring-shaped. The first curved surface 7 is positioned below the point P2. The first curved surface 7 includes the deepest portion P1. The second curved surface 8 is positioned between the points P3 and P4. The third curved surface 9 is positioned between the points P2 and P3. The fourth curved surface 10 is positioned above the point P5. The fifth curved surface 11 is positioned between the points P4 and P5. The first curved surface 7 is linked to the third curved surface 9. The third curved surface 9 is linked to the first curved surface 7 and the second curved surface 8. The second curved surf ace 8 is linked to the third curved surf ace 9 and the fifth curved surface 11. The fifth curved surface 11 is linked to the second curved surface 8 and the fourth curved surface 10. The fourth curved surface 10 is linked to the fifth curved surface 11 and the 1 and 5. In other words, the first curved surface 7, the third curved surface 9, the second curved surface 8, the fifth curved surface 11 and the fourth curved surface 10 are continuously provided in this order from the deepest portion P1 toward the edge E.

The first curved surface 7 is wholly convexed inward. The first curved surface 7 may be partially convexed outward or may be partially flat inward and outward directions, and is preferably convexed inward within a full range. In this specification, "the curved surface is flat in inward and outward directions" implies that a section in the longitudinal direction of the curved surface is a straight line. The second curved surface 8 is wholly convexed inward. The second curved surface 8 may be partially convexed outward or may be partially flat in inward and outward directions, and is preferably convexed inward within a full range. The third curved surface 9 is wholly convexed inward. The third curved surface 9 may be partially convexed outward or may be partially flat in inward and outward directions, and is preferably convexed inward within a full range. The fourth curved surface 10 is wholly convexed outward. The fourth curved surface 10 may be partially convexed inward or may be partially flat in inward and outward directions, and is preferably convexed outward within a full range.

The fifth curved surface 11 may be formed by only an inward convex region, only an outward convex region, only a flat region in inward and outward directions or a plurality of convex regions having different directions. As described above, the fifth curved surface 11 is linked to the second curved surface 8 and the fourth curved surface 10. Accordingly, it is preferable that a lower region of the fifth curved surface 11 (a region linked to the second curved surface 8) should be inward convexed and an upper region thereof (a region linked to the fourth curved surface 10) should be outward convexed. In this case, it is preferable that the fifth curved surface 11 should include an inflection point of the inward convex region and the outward convex region.

A radius of curvature R1 of the first curved surface 7 is a radius of a circular arc assumed to pass through three points including the point P2 shown in FIG. 4, another point P2 opposed to the point P2 with the deepest portion P1 interposed therebetween and the deepest portion P1. A region provided between the point P2 and another point P2 in the circular arc is inward convexed. A radius of curvature R2 of the second curved surface 8 is a radius of a circular arc assumed to pass through three points including the point P3, a lower point from the edge E by a distance of (Dp·0.35), and the point P4. A region provided between the points P3 and P4 in the circular arc is inward convexed. A radius of curvature R3 of the third curved surface 9 is a radius of a circular arc assumed to pass through three points including the point P2, a lower point from the edge E by a distance of (Dp·0.675) and the point P3. It is preferable that a region provided between the points P2 and P3 in the circular arc should be inward convexed. A radius of curvature R4 of the fourth curved surface 10 is a radius of a circular arc assumed to pass through three points including the point P5, a lower point from the edge E by a distance of (Dp·0.05) and the edge E. A region provided between the point P5 and the edge E in the circular arc is outward convexed.

In the dimple 4, a ratio (R1/R2) is 5 or more. The ratio (R1/R2) is higher than a ratio (R1/R2) of a conventional double radius dimple. The dimple 4 contributes to the flight performance of the golf ball 1. The reason why the dimple 4 contributes to the flight performance of the golf ball 1 is unknown in detail. It is guessed that the air flowing from the land toward the deepest portion P1 is disturbed due to the high ratio (R1/R2), resulting in a reduction in a drag. In respect of the flight performance, the ratio (R1/R2) is preferably 10 or more, desirably 13 or more, more preferably 15 or more, more desirably 20 or more, and most preferably 22 or more. If the ratio (R1/R2) is excessively high, the air flow over the first curved surface 7 becomes monotonous. Therefore, the ratio (R1/R2) is preferably 55 or less, desirably 52 or less, more preferably 50 or less and most preferably 40 or less.

In all the dimples 4, it is preferable that a ratio (R1/R2) of 5 to 55 should be achieved. In the case in which the ratio (R1/R2) is within the range in a part of the dimples 4 and is beyond the range in the residual dimples 4, a percentage of the number of the dimples 4 having the ratio (R1/R2) within the range to the total number of the dimples 4 is set to be 20% or more. The percentage is more preferably 50% or more, further preferably 70% or more, more desirably 85% or more, and particularly preferably 90% or more.

The radius of curvature R1 is preferably 2 mm to 60 mm, desirably 4 mm to 59 mm, more preferably 5 mm to 58 mm, more desirably 10 mm to 57 mm, particularly preferably 15 mm to 56 mm, and most preferably 20 mm to 55 mm. The radius of curvature R2 is preferably 0.3 mm to 20 mm, desirably 0.5 mm to 19 mm, more preferably 0.5 mm to 18 mm, particularly preferably 0.5 mm to 10 mm, and most preferably 0.8 mm to 5 mm.

In the golf ball 1, an inclination angle in the horizontal direction of the second curved surface 8 is great. Therefore, the vicinity of the edge E is apt to be damaged during hitting. In the golf ball 1, the vicinity of the edge E is formed by the fourth curved surface 10, that is, an outward convexed and curved surface. The fourth curved surface 10 contributes to the prevention of the damage in the vicinity of the edge E during the hitting. In respect of the prevention of the damage, the radius of curvature R4 of the fourth curved surface 10 is preferably 0.1 mm or more, more preferably 0.2 mm or more, and particularly preferably 0.3 mm or more. If the radius of curvature R4 is too great, an insufficient dimple effect is produced by the second curved surface 8. Therefore, the radius of curvature R4 is preferably 5.0 mm or less, more preferably 4.0 mm or less, and particularly preferably 3.0 mm or less.

An arrow F in FIG. 4 indicates a distance between the phantom sphere 6 and the deepest portion P1. It is preferable that the distance F should be 0.0 mm to 0.60 mm. In some cases in which the distance F is smaller than the range, a trajectory is too high. In this respect, the distance F is more preferably 0.125 mm or more, further preferably 0.15 mm or more, and particularly preferably 0.20 mm or more. In some cases in which the distance F is greater than the range, the trajectory is too low. In this respect, the distance F is more preferably 0.55 mm or less, and particularly preferably 0.50 mm or less.

An arrow $\alpha$ in FIG. 4 indicates an angle formed by a straight line connecting the points P3 and P4 in the direction of a depth. It is preferable that the angle $\alpha$ should be 65 to 85 degrees. If the angle $\alpha$ is smaller than the range, the vicinity of the edge E is apt to be damaged during hitting. In this respect, the angle $\alpha$ is preferably 67 degrees or more, more preferably 70 degrees or more, further preferably 77 degrees or more, and most preferably 79 degrees or more. In some cases in which the angle $\alpha$ is greater than the range, the second curved surface 8 less contributes to an aerodynamic characteristic so that the flight distance of the golf ball 1 becomes insufficient. In this respect, the angle $\alpha$ is preferably 84 degrees or less, more preferably 83 degrees or less, and most preferably 82 degrees or less.

As described above, the third curved surface 9 is linked to the first curved surface 7 and the second curved surface B. It is preferable that the first curved surface 7 and the third curved surface 9 are provided in contact with each other. It is preferable that the second curved surface 8 and the third curved surface 9 should be provided in contact with each other. The radius of curvature R3 of the third curved surface 9 is preferably 0.3 mm to 60 mm, more preferably 0.3 mm to 40 mm, and particularly preferably 0.5 mm to 30 mm. The radius of curvature R3 is preferably equal to or smaller than the radius of curvature R1 of the first curved surface 7, and is particularly preferably smaller than the radius of curvature R1. The radius of curvature R3 is preferably equal to or smaller than the radius of curvature R2 of the second curved surface 8, and is particularly preferably smaller than the radius of curvature R2.

In FIG. 4, the volume of a portion surrounded by the phantom sphere 6 and the dimple 4 is that of the dimple 4. The total volume of the dimples 4 is 300 $mm^3$ to 750 $mm^3$. In some cases in which the total volume is less than the range, a trajectory is too high. In this respect, the total volume is more preferably 350 $mm^3$ or more and particularly preferably 400 $mm^3$ or more. In some cases in which the total volume is more than the range, the trajectory might be too low. In this respect, the total volume is more preferably 700 $mm^3$ or less and particularly preferably 600 $mm^3$ or less.

In the golf ball 1 shown in FIGS. 1 to 4, the A dimple has a volume of 1.587 $mm^3$, the B dimple has a volume of 1.087 $mm^3$, the C dimple has a volume of 0.938 $mm^3$, and the D dimple has a volume of 0.771 $mm^3$. The golf ball 1 has a total volume of 507.7 $mm^3$.

A ratio of the total area of the dimples 4 to the surface area of the phantom sphere 6 will be referred to as a surface area occupation ratio. It is preferable that the surface area occupation ratio should be 70% to 90%. If the surface area occupation ratio is less than the range, the lift of the flying golf ball 1 might be insufficient. In this respect, the surface area occupation ratio is more preferably 72% or more and particularly preferably 75% or more. In some cases in which the surface area occupation ratio is more than the range, the dimple 4 interferes with other dimples 4. In this respect, the surface area occupation ratio is more preferably 88% or less and particularly preferably 86% or less.

An area of the dimple 4 represents an area of a region surrounded by an edge line (that is, an area of a plane shape) when the center of the golf ball 1 is seen at infinity. In the case of the dimple 4 having a circular plane shape, an area s is calculated by the following equation.

$$s=(d/2)^2\times\pi$$

In the golf ball 1 shown in FIGS. 1 to 4, the A dimple has an area of 13.20 $mm^2$, the B dimple has an area of 10.18 mm the C dimple has an area of 9.08 $mm^2$, and the D dimple has an area of 8.04 $mm^2$. The total area of the dimples 4 is 4602.0 $mm^2$. The total area is divided by the surface area of the phantom sphere 6 so that a surf ace area occupation ratio is calculated. In the golf ball 1, the surface area occupation ratio is 80.3%.

It is preferable that the total number of the dimples 4 should be 200 to 500. If the total number is less than the range, the dimple effect is obtained with difficulty. In this respect, the total number is more preferably 230 or more and particularly preferably 260 or more. If the total number is more than the range, the dimple effect is obtained with difficulty due to a small size of each dimple. In this respect, the total number is more preferably 470 or less and particularly preferably 440 or less.

At least one kind of dimples 4 may be formed. Anon-circular dimple (the dimple having a non-circular plane shape) may be formed in place of the circular dimple 4 or together with the circular dimple 4. Specific examples of the non-circular dimple include a polygonal dimple, an oval dimple, an elliptical dimple and an egg-shaped dimple. In the case of the non-circular dimple, four sections are selected every 45 degrees. In these sections, the radii of curvature R1, R2, R3 and R4 and the distance F are measured. Data thus obtained are averaged.

The golf ball 1 shown in FIG. 1 has a two-pieces structure. Also in a multipiece golf ball, a wound golf ball or a one-piece golf ball, a flight performance can be enhanced by the selection of a proper sectional shape.

EXAMPLES

[Example 1]

A core formed of a solid rubber and having a diameter of 38.4 mm was put in a mold and an ionomer resin composition was injected around the core to form a cover. The surface of the cover was coated so that a golf ball according to an example 1 which has a dimple pattern shown in a plan view of FIG. 2 and a front view of FIG. 3 was obtained. The golf ball had an outside diameter of approximately 42.70 mm and a weight of approximately 45.4 g. A compression of the golf ball which was measured by a compression tester produced by Atti Engineering Co., Ltd. is approximately 85. The, golf ball has four kinds of dimples A to D. The total number of the dimples is 432. Each dimple includes a first curved surface, a second curved surface, a third curved surface, a fourth curved surface and a fifth curved surface. The first curved surface, the second curved surface and the third curved surface are inward convexed. The fourth curved surface is outward convexed. In the A dimple, a radius of curvature R1 of the first curved surface is 30.00 mm, a radius of curvature R2 of the second curved surface is 1.00 mm, a radius of curvature R3 of the third curved surface is 1.00 mm, a radius of curvature R4 of the fourth curved surface is 0.50 mm, and a ratio (R1/R2) is 30.00. In the B dimple, a radius of curvature R1 of the first curved surface is 30.00 mm, a radius of curvature R2 of the second curved surface is 1.00 mm, a radius of curvature R3 of the third curved surface is 1.00 mm, a radius of curvature R4 of the fourth curved surface is 0.50 mm, and a ratio (R1/R2) is 30.00. In the C dimple, a radius of curvature R1 of the first curved surface is 30.00 mm, a radius of curvature R2 of the second curved surface is 1.00 mm, a radius of curvature R3 of the third curved surface is 1.00 mm, a radius of curvature R4 of the fourth curved surface is 0.50 mm, and a ratio (R1/R2) is 30.00. In the D dimple, a radius of curvature R1 of the first curved surface is 32.50 mm, a radius of curvature 2 of the second curved surface is 1.50 mm, a radius of curvature R3 of the third curved surf ace is 1.50 mm, a radius of curvature R4 of the fourth curved surface is 0.50 mm, and a ratio (R1/R2) is 21.67. A percentage X of the number of the dimples having a ratio (R1/R2) of 5 to 55 to the total number of the dimples is 100%. Also in all the dimples A to D, the fifth curved surface is constituted by a lower region linked to the second curved surface and an upper region linked to the fifth curved surface. The lower region is inward convexed and the upper region is outward convexed. The lower region and the upper region are provided in contact with each other.

[Examples 2 to 8 and Comparative Examples 1 to 3]

A golf ball according to each of examples 2 to 8 and comparative examples 1 to 3 was obtained in the same manner as that in the first example except that the specification of a dimple is set as shown in the following Tables 1, 2 and 3. A and D dimples in the example 7, A and B dimples in the example 8, A and D dimples in the comparative example 1 and A, B, C and D dimples in the comparative example 3 are single radius dimples.

[Flight Distance Test]

A driver comprising a metal head ("XXIO W#1" produced by Sumitomo Rubber Industries, Ltd., loft: B degrees, shaft hardness: X) was attached to a swing machine (produced by True Temper Co.). A golf ball was hit on the condition that a head speed is 49 m/sec, a launch angle is approximately 11 degrees, and a back spin speed is approximately 3000 rpm. Thus, a flight distance (a distance between a launch point and a stationary point) was measured. It was almost windless at time of the measurement. The following Tables 1, 2 and 3 show the mean value of the results of the measurement for 20 golf balls.

TABLE 1

Sepcification of Dimple and Result of Evaluation

| | | Number | R1 (mm) | R2 (mm) | R4 (mm) | d (mm) | F (mm) | α (deg.) | R1/R2 | Volume ($mm^3$) | Total volume ($mm^3$) | X (%) | Flight distance (m) |
|---|---|---|---|---|---|---|---|---|---|---|---|---|---|
| Example 1 | A | 132 | 30.00 | 1.00 | 0.50 | 4.10 | 0.209 | 79 | 30.00 | 1.587 | 507.7 | 100.0 | 235.0 |
| | B | 180 | 30.00 | 1.00 | 0.50 | 3.60 | 0.175 | 79 | 30.00 | 1.087 | | | |
| | C | 60 | 30.00 | 1.00 | 0.50 | 3.40 | 0.164 | 79 | 30.00 | 0.938 | | | |
| | D | 60 | 32.50 | 1.50 | 0.50 | 3.20 | 0.145 | 79 | 21.67 | 0.771 | | | |
| Example 2 | A | 132 | 22.00 | 1.00 | 0.50 | 4.10 | 0.238 | 81 | 22.00 | 1.588 | 507.9 | 100.0 | 234.4 |
| | B | 180 | 22.00 | 1.00 | 0.50 | 3.60 | 0.198 | 81 | 22.00 | 1.085 | | | |
| | C | 60 | 22.00 | 1.00 | 0.50 | 3.40 | 0.184 | 81 | 22.00 | 0.939 | | | |
| | D | 60 | 22.00 | 1.00 | 0.50 | 3.20 | 0.168 | 81 | 22.00 | 0.777 | | | |
| Example 3 | A | 132 | 50.00 | 1.00 | 0.50 | 4.10 | 0.194 | 77 | 50.00 | 1.583 | 507.7 | 100.0 | 233.9 |
| | B | 180 | 50.00 | 1.00 | 0.50 | 3.60 | 0.160 | 77 | 50.00 | 1.089 | | | |
| | C | 60 | 50.00 | 1.00 | 0.50 | 3.40 | 0.149 | 77 | 50.00 | 0.939 | | | |
| | D | 60 | 40.00 | 1.00 | 0.50 | 3.20 | 0.144 | 77 | 40.00 | 0.772 | | | |
| Example 4 | A | 132 | 13.55 | 1.00 | 0.50 | 4.10 | 0.247 | 82 | 13.55 | 1.586 | 508.1 | 100.0 | 233.5 |
| | B | 180 | 12.15 | 1.00 | 0.50 | 3.60 | 0.213 | 82 | 12.15 | 1.090 | | | |
| | C | 60 | 11.45 | 1.00 | 0.50 | 3.40 | 0.201 | 82 | 11.45 | 0.938 | | | |
| | D | 60 | 11.06 | 1.00 | 0.50 | 3.20 | 0.185 | 82 | 11.06 | 0.770 | | | |

TABLE 2

Sepcification of Dimple and Result of Evaluation

| | | Number | R1 (mm) | R2 (mm) | R4 (mm) | d (mm) | F (mm) | α (deg.) | R1/R2 | Volume ($mm^3$) | Total volume ($mm^3$) | X (%) | Flight distance (m) |
|---|---|---|---|---|---|---|---|---|---|---|---|---|---|
| Example 5 | A | 132 | 10.00 | 1.00 | 0.50 | 4.10 | 0.277 | 82 | 10.00 | 1.585 | 508.1 | 100.0 | 233.0 |
| | B | 180 | 10.00 | 1.00 | 0.50 | 3.60 | 0.234 | 82 | 10.00 | 1.091 | | | |
| | C | 60 | 10.00 | 1.00 | 0.50 | 3.40 | 0.219 | 82 | 10.00 | 0.938 | | | |
| | D | 60 | 10.00 | 1.00 | 0.50 | 3.20 | 0.200 | 82 | 10.00 | 0.770 | | | |
| Example 6 | A | 132 | 7.00 | 1.00 | 0.50 | 4.10 | 0.315 | 82 | 7.00 | 1.585 | 507.8 | 100.0 | 232.7 |
| | B | 180 | 7.00 | 1.00 | 0.50 | 3.60 | 0.267 | 82 | 7.00 | 1.088 | | | |
| | C | 60 | 7.00 | 1.00 | 0.50 | 3.40 | 0.251 | 82 | 7.00 | 0.938 | | | |
| | D | 60 | 7.00 | 1.00 | 0.50 | 3.20 | 0.230 | 82 | 7.00 | 0.773 | | | |
| Example 7 | A | 132 | 12.80 | | 0.50 | 4.10 | 0.269 | 83 | 1.00 | 1.587 | 507.9 | 55.6 | 232.2 |
| | B | 180 | 30.00 | 1.00 | 0.50 | 3.60 | 0.174 | 79 | 30.00 | 1.087 | | | |
| | C | 60 | 30.00 | 1.00 | 0.50 | 3.40 | 0.163 | 79 | 30.00 | 0.943 | | | |
| | D | 60 | 8.80 | | 0.50 | 3.20 | 0.222 | 83 | 1.00 | 0.772 | | | |
| Example 8 | A | 132 | 12.80 | | 0.50 | 4.10 | 0.269 | 83 | 1.00 | 1.587 | 507.9 | 27.8 | 232.0 |
| | B | 180 | 11.20 | | 0.50 | 3.60 | 0.234 | 83 | 1.00 | 1.087 | | | |
| | C | 60 | 30.00 | 1.00 | 0.50 | 3.40 | 0.163 | 79 | 30.00 | 0.943 | | | |
| | D | 60 | 32.50 | 1.50 | 0.50 | 3.20 | 0.144 | 79 | 21.66 | 0.772 | | | |

TABLE 3

Sepcification of Dimple and Result of Evaluation

| | | Number | R1 (mm) | R2 (mm) | R4 (mm) | d (mm) | F (mm) | α (deg.) | R1/R2 | Volume ($mm^3$) | Total volume ($mm^3$) | X (%) | Flight distance (m) |
|---|---|---|---|---|---|---|---|---|---|---|---|---|---|
| Comp. example 1 | A | 132 | 12.80 | | 0.50 | 4.10 | 0.269 | 86 | 1.00 | 1.587 | 507.6 | 13.8 | 231.4 |
| | B | 180 | 56.00 | 1.00 | 0.50 | 3.60 | 0.154 | 77 | 56.00 | 1.087 | | | |
| | C | 60 | 53.25 | 1.00 | 0.50 | 3.40 | 0.144 | 77 | 53.25 | 0.937 | | | |
| | D | 60 | 8.80 | | 0.50 | 3.20 | 0.222 | 86 | 1.00 | 0.772 | | | |
| Com. example 2 | A | 132 | 12.00 | 3.00 | 0.50 | 4.10 | 0.266 | 85 | 4.00 | 1.585 | 507.9 | 0.0 | 231.0 |
| | B | 180 | 12.00 | 3.00 | 0.50 | 3.60 | 0.223 | 85 | 4.00 | 1.087 | | | |
| | C | 60 | 12.00 | 3.00 | 0.50 | 3.40 | 0.210 | 85 | 4.00 | 0.944 | | | |
| | D | 60 | 12.00 | 3.00 | 0.50 | 3.20 | 0.190 | 85 | 4.00 | 0.773 | | | |
| Com. example 3 | A | 132 | 12.80 | | 0.50 | 4.10 | 0.269 | 86 | 1.00 | 1.587 | 507.9 | 0.0 | 230.5 |
| | B | 180 | 11.20 | | 0.50 | 3.60 | 0.234 | 86 | 1.00 | 1.087 | | | |
| | C | 60 | 9.60 | | 0.50 | 3.40 | 0.234 | 86 | 1.00 | 0.943 | | | |
| | D | 60 | 8.80 | | 0.50 | 3.20 | 0.222 | 86 | 1.00 | 0.772 | | | |

As shown in the Tables 1, 2 and 3, the golf balls according to the examples have greater flight distances than those of the golf balls according to the comparative examples. From the results of evaluation, the advantage of the present invention is apparent.

The above description is only illustrative and can be variously changed without departing from the scope of the present invention.

What is claimed is:

1. A golf ball comprising a large number of dimples on a surface thereof, wherein a percentage of 20% or more compared to a total number of the dimples has the following characteristics:

a number of the dimples in which a first curved surface is provided from a position placed downward by 85% of a depth to a position placed downward by 100% of the depth in a direction of the depth from a dimple edge and a second curved surface is provided from a position placed downward by 20% of the depth to a position placed downward by 50% of the depth in the direction of the depth from the dimple edge, and a ratio (R1/R2) of a radius of curvature R1 of the first curved surface to a radius of curvature R2 of the second curved surface is 5 to 55.

2. The golf ball according to claim 1, wherein a distance F between the deepest portion of the dimple and a phantom sphere is 0.10 mm to 0.60 mm.

* * * * *